US010617159B2

(12) United States Patent
Lynch

(10) Patent No.: US 10,617,159 B2
(45) Date of Patent: Apr. 14, 2020

(54) HIGH VISIBILITY GARMENTS FOR OPERATIVES WORKING IN A HAZARDOUS ENVIRONMENTS

(71) Applicant: Wearable Technology Limited, Leicester (GB)

(72) Inventor: Michael John Lynch, Leicester (GB)

(73) Assignee: Wearable Technology Limited, Leicester (GB)

( * ) Notice: Subject to any disclaimer, the term of this patent is extended or adjusted under 35 U.S.C. 154(b) by 0 days.

(21) Appl. No.: 16/143,921

(22) Filed: Sep. 27, 2018

(65) Prior Publication Data

US 2019/0098941 A1 Apr. 4, 2019

(30) Foreign Application Priority Data

Sep. 30, 2017 (GB) ..... 1716032.6

(51) Int. Cl.
*G08B 5/00* (2006.01)
*A41D 13/01* (2006.01)
(Continued)

(52) U.S. Cl.
CPC ..... *A41D 13/01* (2013.01); *A41D 27/085* (2013.01); *A41D 31/32* (2019.02); *F21V 33/0008* (2013.01); *A41D 2600/20* (2013.01)

(58) Field of Classification Search
CPC ..... A41D 13/01; A41D 31/32; A41D 27/085; A41D 2600/20; A41D 1/005;
(Continued)

(56) References Cited

U.S. PATENT DOCUMENTS 4,709,307 A * 11/1987 Branom ..... A41D 27/085 362/103
4,774,642 A 9/1988 Janko et al.
(Continued)

FOREIGN PATENT DOCUMENTS

AU 2014271276 A1 6/2016
DE 202009002330 U1 5/2009
ES 1078123 U 11/2012

OTHER PUBLICATIONS

Corresponding Great Britain Search Report, Application No. 1816052.3, dated Mar. 22, 2019, 1 page.
(Continued)

*Primary Examiner* — Donald L Raleigh
(74) *Attorney, Agent, or Firm* — Cooper Legal Group, LLC

(57) ABSTRACT

High-visibility garment for use by operatives working in hazardous environment has base garment and detachable light-reflecting apparatus. Base garment comprises outer shell constructed from florescent material and having internal pocket. Powered control unit with loom socket, is retained within internal pocket. Base garment also includes outer attachment material at positions intended for light-reflective material, with loom hole in outer shell and in outer attachment material. Detachable light-reflecting apparatus has light-reflecting outer material with light-emitting devices extending through device holes. Apparatus has inner attachment material and loom connecting light-emitting devices, in which restrained portion of loom is located between light-reflecting outer material and inner attachment material. Loom also has extended portion that connects to loom plug. Loom plug is inserted within loom socket by passing extended portion through loom hole. Light-reflect-
(Continued)

ing apparatus is attached to base garment by attaching inner attachment material to outer attachment material.

14 Claims, 10 Drawing Sheets

(51) Int. Cl.
*A41D 27/08* (2006.01)
*F21V 33/00* (2006.01)
*A41D 31/32* (2019.01)

(58) Field of Classification Search
CPC ... F21V 33/0008; F21V 21/0832; G08B 5/36; G08B 5/004
See application file for complete search history.

(56) References Cited

U.S. PATENT DOCUMENTS 5,570,945 A * 11/1996 Chien ..... A41D 13/01 362/103
D440,716 S * 4/2001 Lesley ..... A41D 13/01 D29/101.4
6,517,214 B1 * 2/2003 Mitchell, Jr. ..... A41D 13/01 2/94
7,144,127 B2 * 12/2006 Golle ..... A41D 13/01 362/84
7,377,663 B2 5/2008 Desjardin
9,044,055 B2 * 6/2015 Hehenberger ..... A41D 13/01
9,922,516 B2 3/2018 Jones, Jr. et al.
10,405,588 B2 * 9/2019 Wright ..... A41D 13/01
2006/0034064 A1 * 2/2006 Kanzler ..... A41D 13/01 362/84
2008/0043458 A1 2/2008 Desjardin
2008/0198578 A1 * 8/2008 Finn ..... A41B 9/04 362/103
2014/0340877 A1 11/2014 Nelson
2015/0116988 A1 * 4/2015 Uriarte ..... G08B 5/004 362/108
2016/0209016 A1 * 7/2016 Bernstein ..... F21V 23/0407
2018/0132555 A1 * 5/2018 Gonzalez ..... A45F 5/021

OTHER PUBLICATIONS

Corresponding Great Britain Search Report, Application No. 1716032.6, dated Mar. 26, 2018, 1 page.

* cited by examiner

HIGH VISIBILITY GARMENTS FOR OPERATIVES WORKING IN A HAZARDOUS ENVIRONMENTS

CROSS REFERENCE TO RELATED APPLICATIONS

This application claims priority from United Kingdom Patent Application number 1716032.6, filed on Sep. 30, 2017, the whole contents of which are incorporated herein by reference.

BACKGROUND OF THE INVENTION

The present invention relates to a high-visibility garment for use in hazardous environments.

It is known to deploy high-visibility garments that include light-emitting devices for use in hazardous environments, as described in U.S. Pat. No. 9,922,516, assigned to the present applicant. However, it has been appreciated that the deployment of active technology of this type can significantly add to the cost of the garment, therefore some organisations may be reluctant to adopt solutions of this type. Furthermore, relatively inexpensive components may become damaged, which could then result in the replacement of the whole garment.

BRIEF SUMMARY OF THE INVENTION

According to an aspect of the present invention, there is provided a high-visibility garment for use by operatives working in hazardous environments, comprising a base garment and a detachable light-reflecting apparatus. The base garment comprises: an outer shell constructed from a florescent material; an internal pocket; and a powered control unit, including a loom socket, retainable within an internal pocket. The base garment also includes outer attachment material at positions intended for light-reflective material; and an outer loom hole in the outer shell and in the outer attachment material. The detachable light-reflecting apparatus comprises: a light-reflecting outer material; a plurality of light-emitting devices extending through device holes in the outer material; an inner attachment material; and a loom connecting the light-emitting devices, in which a restrained portion of the loom is located between the light-reflecting outer material and the inner attachment material, and an extended portion of said loom connects to a loom plug. The loom plug is insertable within the loom socket by passing the extended portion through the outer loom hole. The detachable light-reflecting apparatus is detachably attached to the base garment by attaching the inner attachment material to the outer attachment material.

Embodiments of the invention will be described, by way of example only, with reference to the accompanying drawings. The detailed embodiments show the best mode known to the inventor and provide support for the invention as claimed. However, they are only exemplary and should not be used to interpret or limit the scope of the claims. Their purpose is to provide a teaching to those skilled in the art. Components and processes distinguished by ordinal phrases such as "first" and "second" do not necessarily define an order or ranking of any sort.

BRIEF DESCRIPTION OF THE SEVERAL VIEWS OF THE DRAWINGS

FIG. 1

Figure 1:
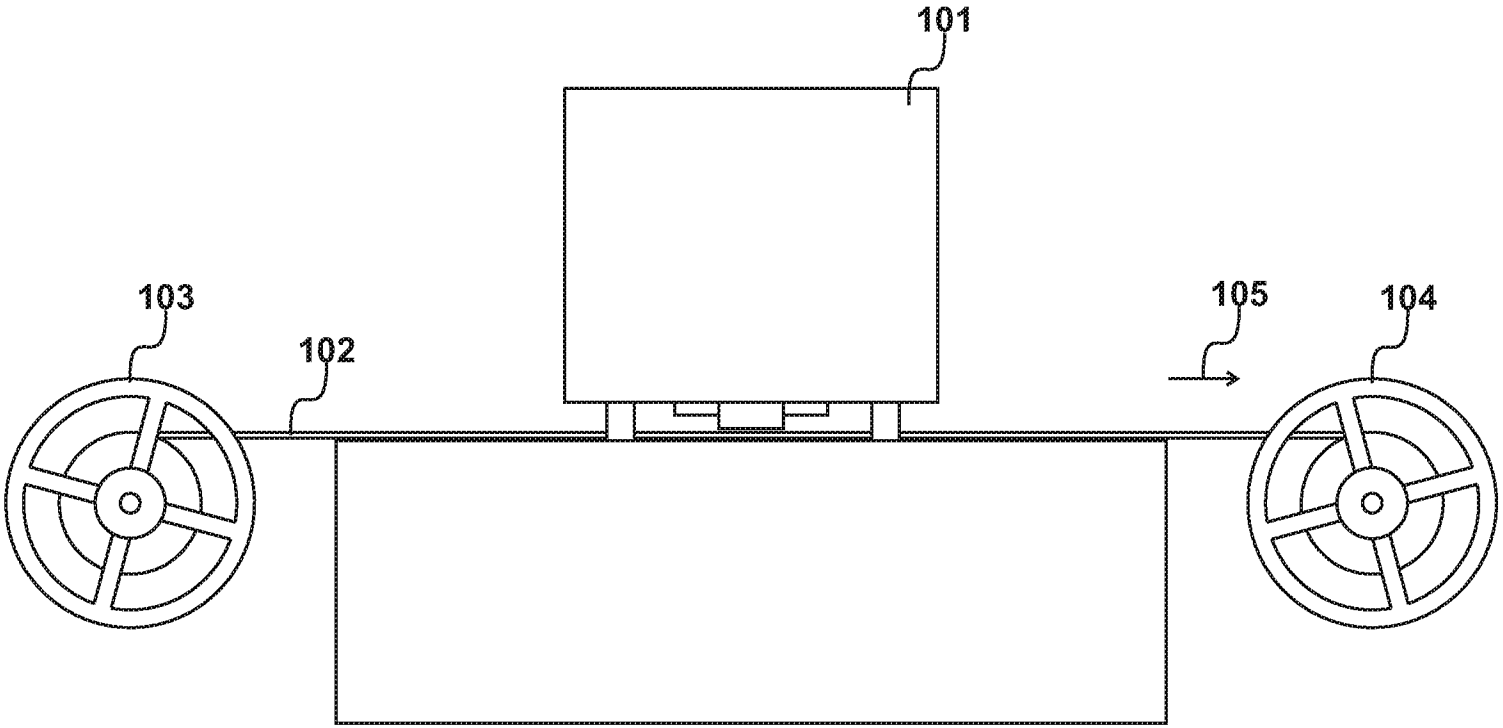
FIG. 1 shows a laser-cutting device.

A laser-cutting device 101 is shown in FIG. 1. A light-reflecting outer material 102 is unrolled from a first reel 103 to a second reel 104 in the direction of arrow 105. A laser-cutting operation is performed to laser cut plural device holes in each predetermined length, at specified locations.

FIG. 2

Figure 2:
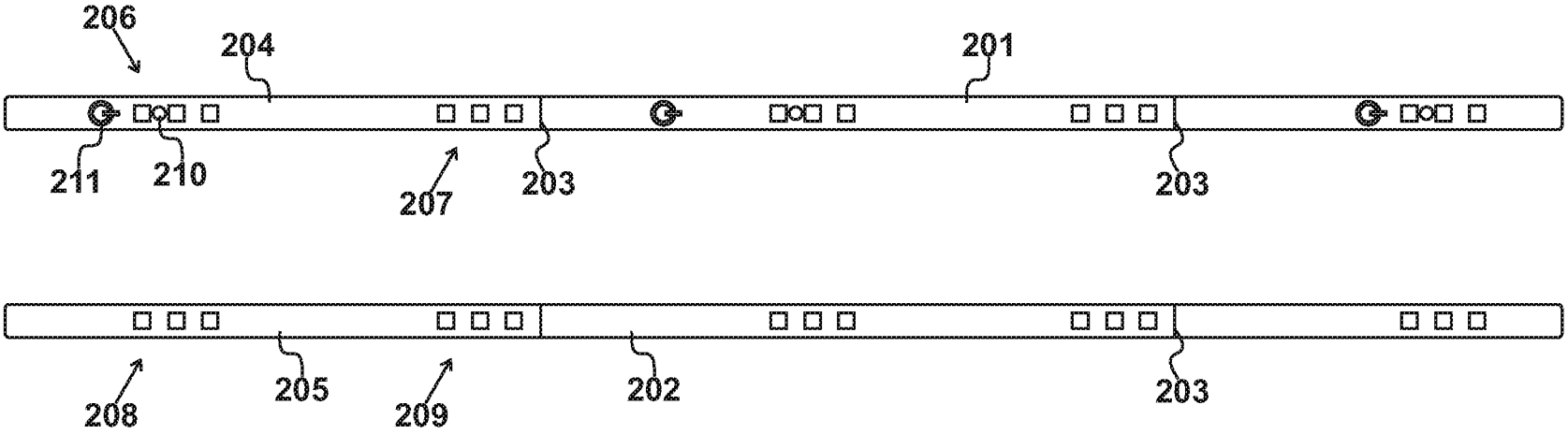
FIG. 2 shows components manufactured by the laser-cutting device shown in FIG. 1.

The laser-cutting operation produces right-shoulder sections 201 and left-shoulder sections 202, as shown in FIG. 2. The right-shoulder sections 201 have cut indications 203 (with similar cut indications 203 on the left-shoulder sections 202) indicating where cuts should occur to identify individual sections. Thus, after cutting, the sections include a right-shoulder section 204 and a left-shoulder section 205.

The laser-cutting operation cuts a first group of device holes 206 and a second group of device holes 207 in the right-shoulder section 204. Similarly, a third group of device holes 208 and a fourth group of device holes 209 are cut in the left-shoulder section 205. In this embodiment, each group of device holes includes three holes, each for receiving a respective light-emitting device. Furthermore, the first group of device holes 206 includes an additional hole 210 for receiving a light-detection element. In addition, a visual indication, in the form of a power symbol 211, is engraved at a position that lines up with a powered control unit retained within an internal pocket of a base garment.

Holes present within each group 206 to 209 provide guides for the stitching of rubber covers, provided to protect the electronic elements. In an embodiment, a clear cellophane pocket is also stitched onto the material to house an identification tag.

The light-reflecting outer material is a reflective tape having a width of no less than two inches and is suitable for attachment to safety garments in accordance with established standards. The tape is substantially wipe-cleanable, thereby allowing it to be omitted from machine-washing processes.

Typically, a roll of material on reel 103 is one-hundred-and-fifty feet to six-hundred feet in length and the pre-cutting of holes during the roll-to-roll process ensures that a correct hole spacing is achieved. In FIG. 2, the front of the light-reflecting outer material is shown, this being the surface that has light-reflecting and wipe-cleanable properties.

FIG. 3

Figure 3:
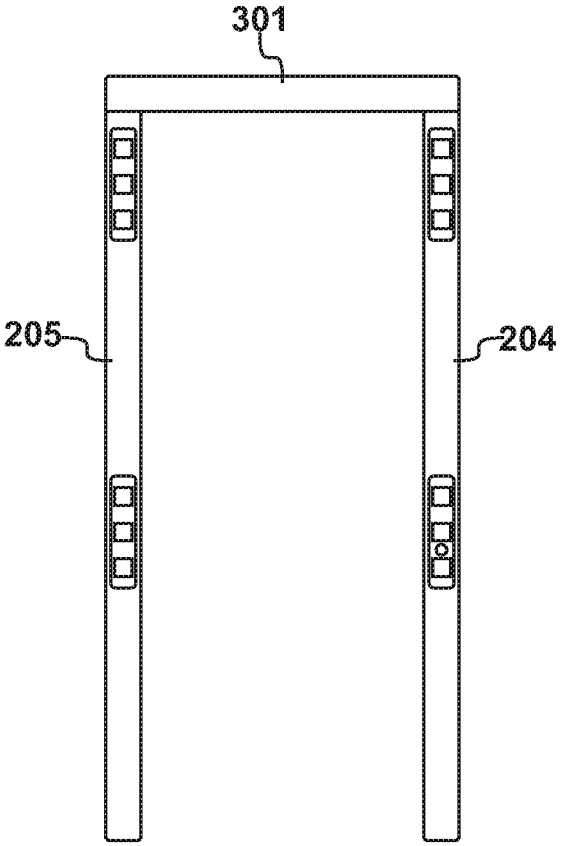
FIG. 3 shows an underside of an assembly.

The underside of the right-shoulder section 204 is shown in FIG. 3, along with the underside of the left-shoulder section 205. The right-shoulder section 204 is connected to the left-shoulder section 205 by a light-reflective back section 301.

FIG. 4

Figure 4:
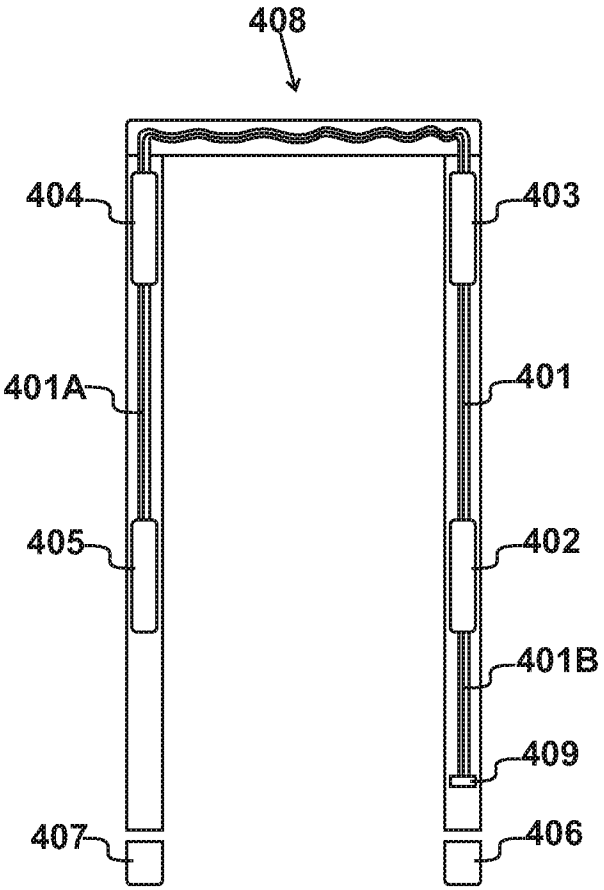
FIG. 4 shows the introduction of a wiring-loom.

A wiring loom 401 is introduced, as shown in FIG. 4, that is restrained between the light-reflecting outer material and an inner attachment material. The input wiring loom 401 connects a first light-emitting-diode strip 402, a second light-emitting-diode strip 403, a third light-emitting-diode strip 404 and a fourth light-emitting-diode strip 405. Each light-emitting-diode strip includes three light-emitting diode devices that, in an embodiment, are capable of producing light of differing colours, under the control of a powered control unit. The three light-emitting devices of each light-emitting-diode strip are received within respective holes of groups 206 to 209. The first light-emitting-diode strip 402 also includes a light-detection device for reception within the additional hole 210.

In the embodiment of FIG. 4, a first excess portion 406 has been removed from the right-shoulder section 204 and a second excess portion 407 has been removed from the left-shoulder section 205; to accommodate the construction of an apparatus of a smaller size. The loom 401 has a restrained portion 401A and an extended portion 401B with an exposed end. A loom-plug 409 is connected to the exposed end of the extended portion. The loom-plug 409 is receivable within a loom socket forming part of the powered control unit.

When the apparatus is deployed, the first light-emitting-diode strip 402 will be at the position of the front-right shoulder, with the second light-emitting-diode strip 403 being at the rear-right shoulder. Similarly, the third light-emitting-diode strip 404 will be at the rear-left shoulder and the fourth light-emitting-diode strip 405 will be at the left-front shoulder.

FIG. 5

Figure 5:
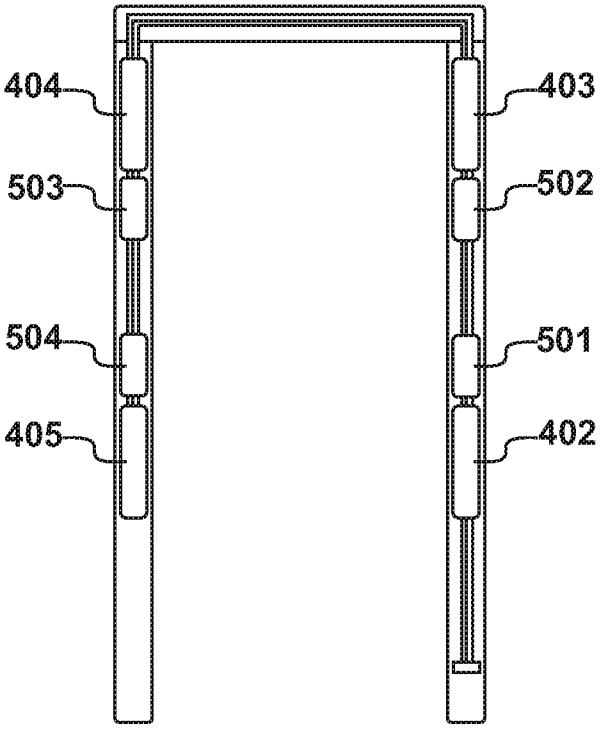
FIG. 5 shows the introduction of radio-frequency identification devices.

In an embodiment, as shown in FIG. 5, a first radio-frequency-identification device 501 is located in proximity to the first light-emitting-diode strip 402 (at the front-right shoulder); a second radio-frequency-identification device 502 is located in proximity to the second light-emitting-diode strip 402 (on the rear-right shoulder); a third radio-frequency-identification device 503 is located in proximity to the third light-emitting-diode strip 404 (on the rear-left shoulder); and a fourth radio-frequency-identification device 504 is located in proximity to the fourth light-emitting-diode strip 402 (on the front-left shoulder). Typically, these devices may be used for indoor tracking, where GPS signals are not available.

FIG. 6

Figure 6:
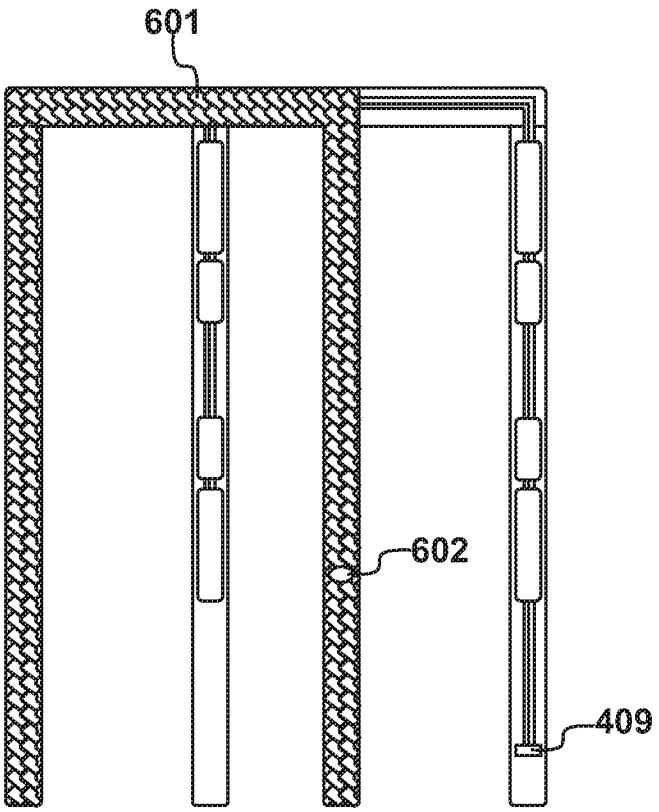
FIG. 6 shows the attachment of a backing-material.

To complete the detachable light-reflecting apparatus, an inner attachment material 601 is applied over the assembly, thereby restraining the restrained portion 401A of the loom by being stitched at its edges, as shown in FIG. 6. The inner attachment material 601 provides attachment means for attaching the light-reflecting apparatus to a base garment, as described with reference to FIG. 11. The loom socket is passed through an inner loom hole 602 in the inner attachment material 601. Upon attachment of the light-reflecting apparatus to a base garment, the extended portion 409 aligns with an outer loom hole in the base garment, to allow the loom plug 409 to connect with a loom socket of a powered control unit.

FIG. 7

Figure 7:
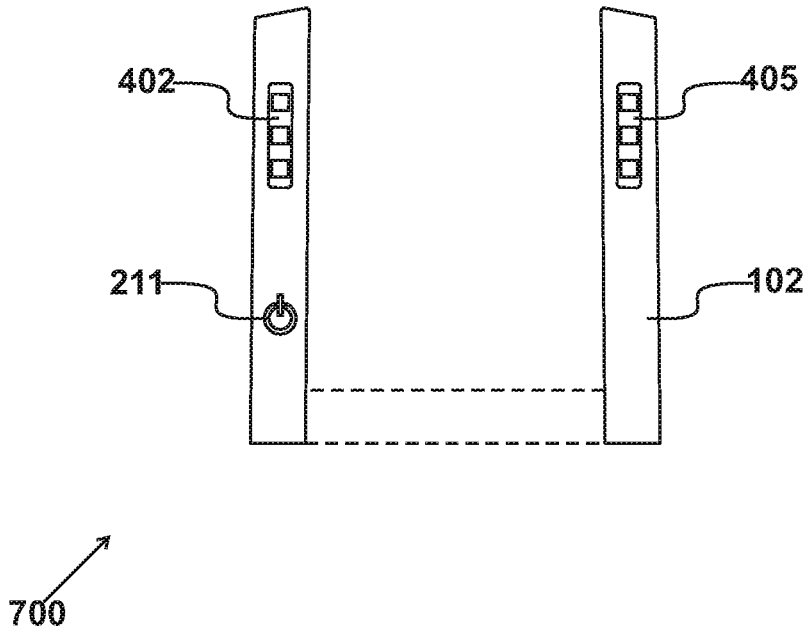
FIG. 7 shows a front portion of an assembled light-emitting-diode apparatus.

The front of an assembled light-reflecting apparatus is shown in FIG. 7. The outer surface of the apparatus is constructed, as previously described, from a light-reflective outer-material 102 that supports the first light-emitting-diode strip 402 and the fourth light-emitting-diode strip 405. Thus, groups of light-emitting devices extend through device-holes in the outer-material.

The apparatus may be attached to a garment using a hook-and-loop system, such as that supplied commercially under the trade mark "Velcro". In an embodiment, the inner attachment material is hook material of the hook-and-loop system. The apparatus also includes the visual indicator 211.

In an alternative embodiment, the light-reflecting apparatus may be attached to a base garment using poppers or zips or any other mechanical fastening suitable for attaching the fabric components.

FIG. 8

Figure 8:
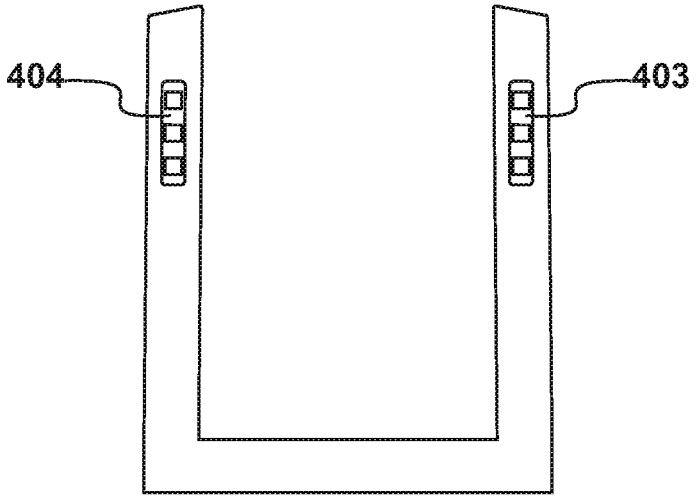
FIG. 8 shows a back portion of the apparatus identified in FIG. 7.

The back of the apparatus is shown in FIG. 8, including the second light-emitting-diode strip 403 and the third light-emitting-diode strip 404. When considering the apparatus as a whole, the light-emitting devices are arranged in four groups, with three light-emitting devices within each group.

FIG. 9

Figure 9:
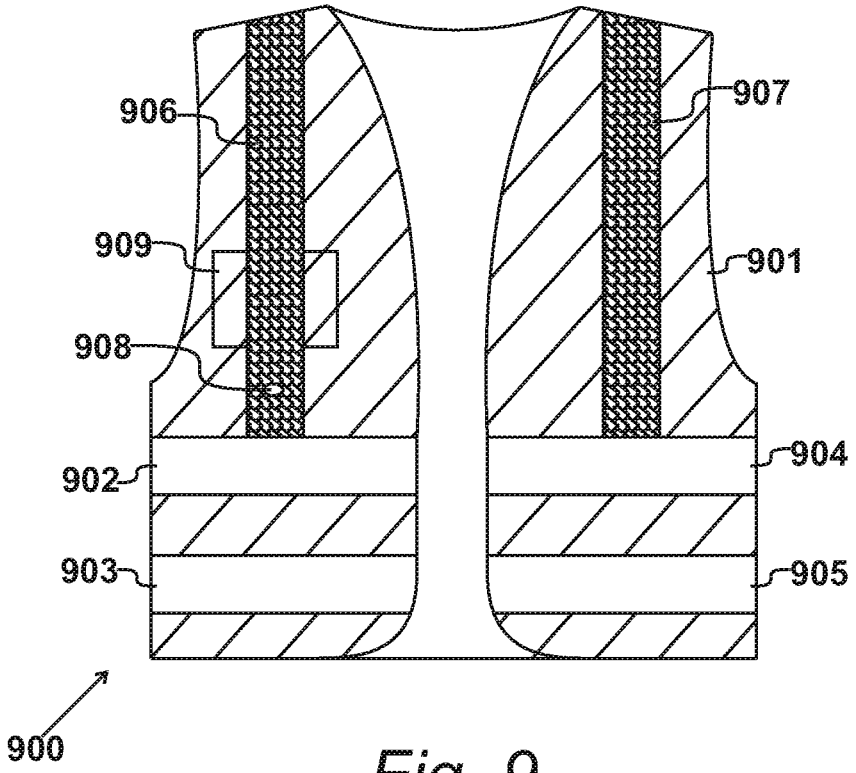
FIG. 9 shows a vest for receiving the apparatus of FIG. 7.

A base garment, in the form of a vest 900, is shown in FIG. 9. The base garment includes an outer shell 901 of a florescent material. The garment includes a first strip 902 of light-reflective material, a second strip 903 of light-reflective material, a third strip 904 of light-reflective material and a fourth strip 905 of light-reflective material 102. The vest also includes a first vertical strip 906 of outer attachment material and a second vertical strip 907 of outer attachment material. When using a hook-and-loop system, strip 906 and strip 907 may be constructed from the loop material.

The loom-plug 409 is inserted through an outer loom hole 908 and thereafter connected to the loom socket of a powered control unit. A powered control unit is supported within an internal pocket 909.

FIG. 10

Figure 10:
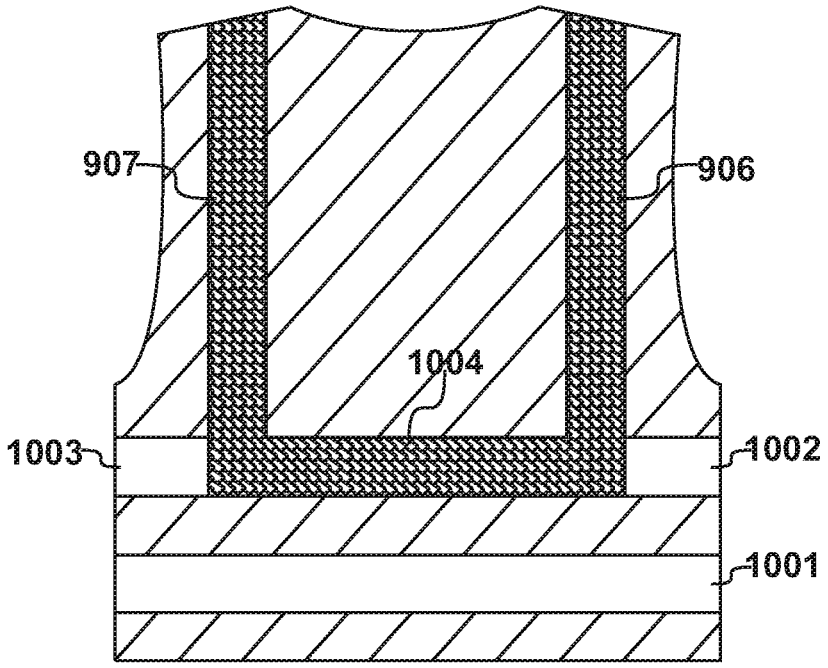
FIG. 10 shows the rear of the vest identified in FIG. 9, for receiving the apparatus shown in FIG. 8.

The rear of the garment of FIG. 9 is shown in FIG. 10. A permanent rear reflective strip 1001 connects the second horizontal strip 903 to the fourth horizontal strip 905. Similarly, a first rear horizontal portion 1002 connects with the first horizontal portion 902 and a second rear horizontal portion 1003 connects with the third horizontal portion 904. The first vertical strip 906 extends around the back, along with the second vertical strip 907. These are connected by a horizontal strip 1004 of outer attachment material.

FIG. 11

Figure 11:
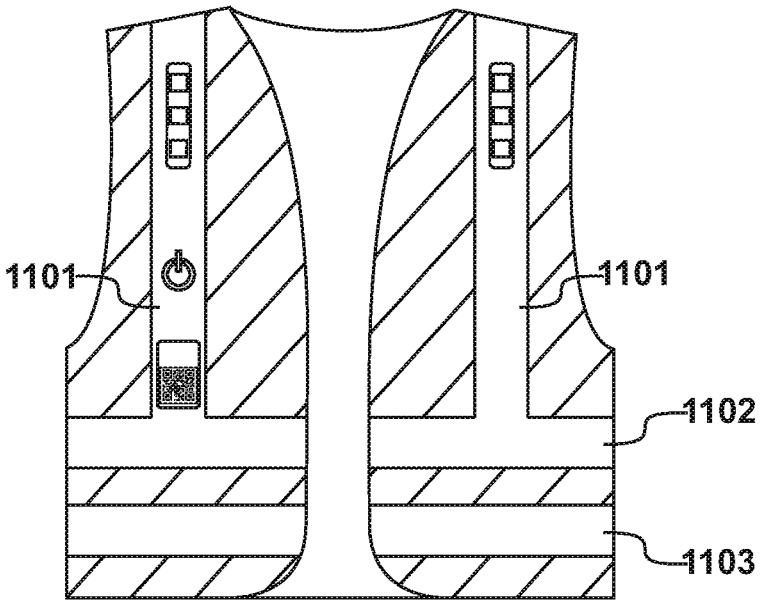
FIG. 11 shows the front of the vest of FIG. 9 after the attachment of the apparatus of FIG. 7.
Figure 12:
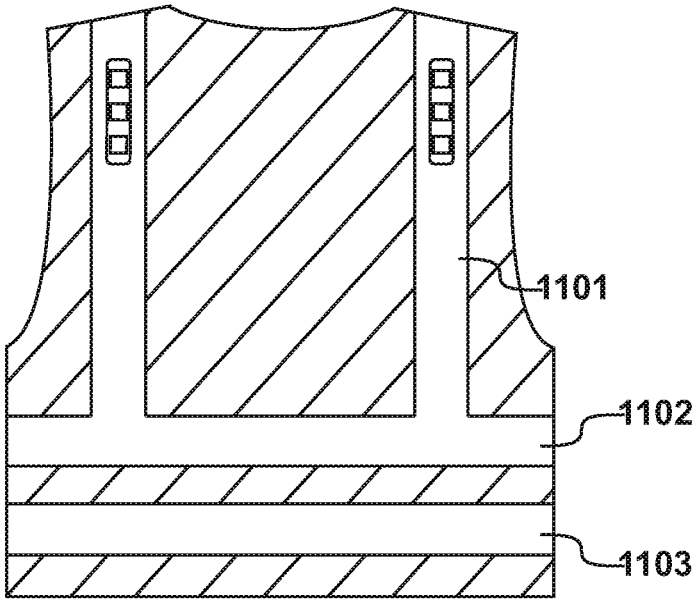
FIG. 12 shows the rear of the vest of FIG. 10 after the attachment of the apparatus of FIG. 8.

The result of attaching the apparatus of FIG. 7 to the garment of FIG. 9 is illustrated in FIG. 11. In this way, the apparatus, in combination with the permanently attached light-reflective material, provides a complete configuration of light-reflective material. This configuration may be summarised as comprising a brace portion 1101, a first belt portion 1102 and a second belt portion 1003.

FIG. 12

A similar arrangement, shown from the rear, may be seen as the combination of the apparatus of FIG. 8 with the garment of FIG. 10. Thus, the brace portion 1001 extends around the back, along with the first belt portion 1102 and the second belt portion 1103.

FIG. 13

Figure 13:
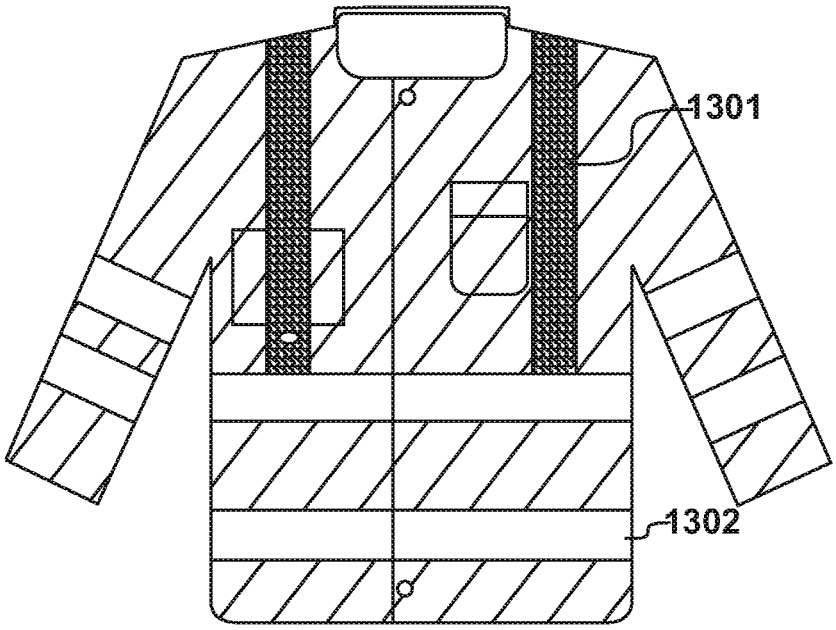
FIG. 13 shows the front of a parka.

In addition to deploying the apparatus of FIG. 7 with the garment of FIG. 9, it is also possible to deploy the apparatus of FIG. 7 with alternative garments, such as a parka, as illustrated in FIG. 13. Thus, the parka of FIG. 13 also includes an outer attachment material 1301, along with complementary light-reflective material 1302.

FIG. 14

Figure 14:
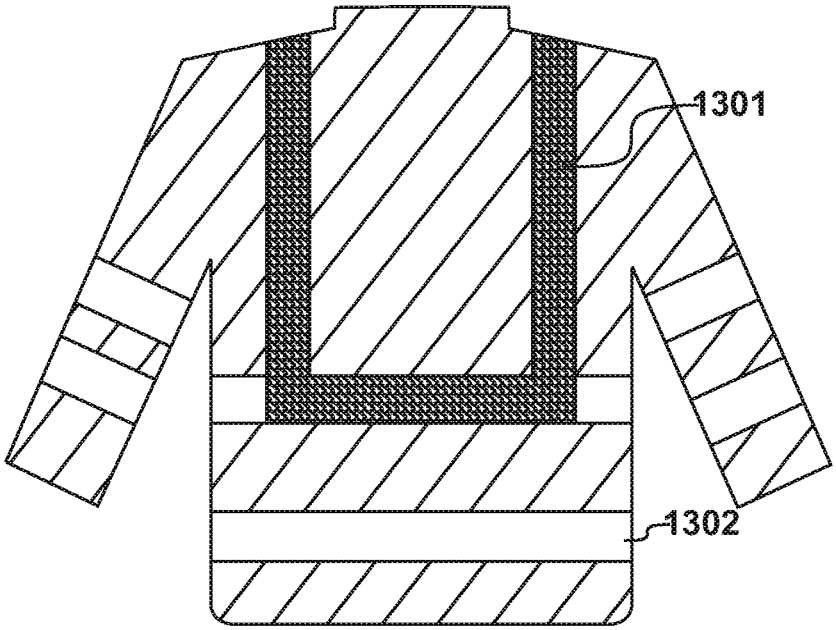
FIG. 14 shows the rear of the parka identified in FIG. 13.

The outer attachment material 1301 extends around the back of the parka, as shown in FIG. 14, which also includes extensions to the complementary light-reflective material 1302.

FIG. 15

Figure 15:
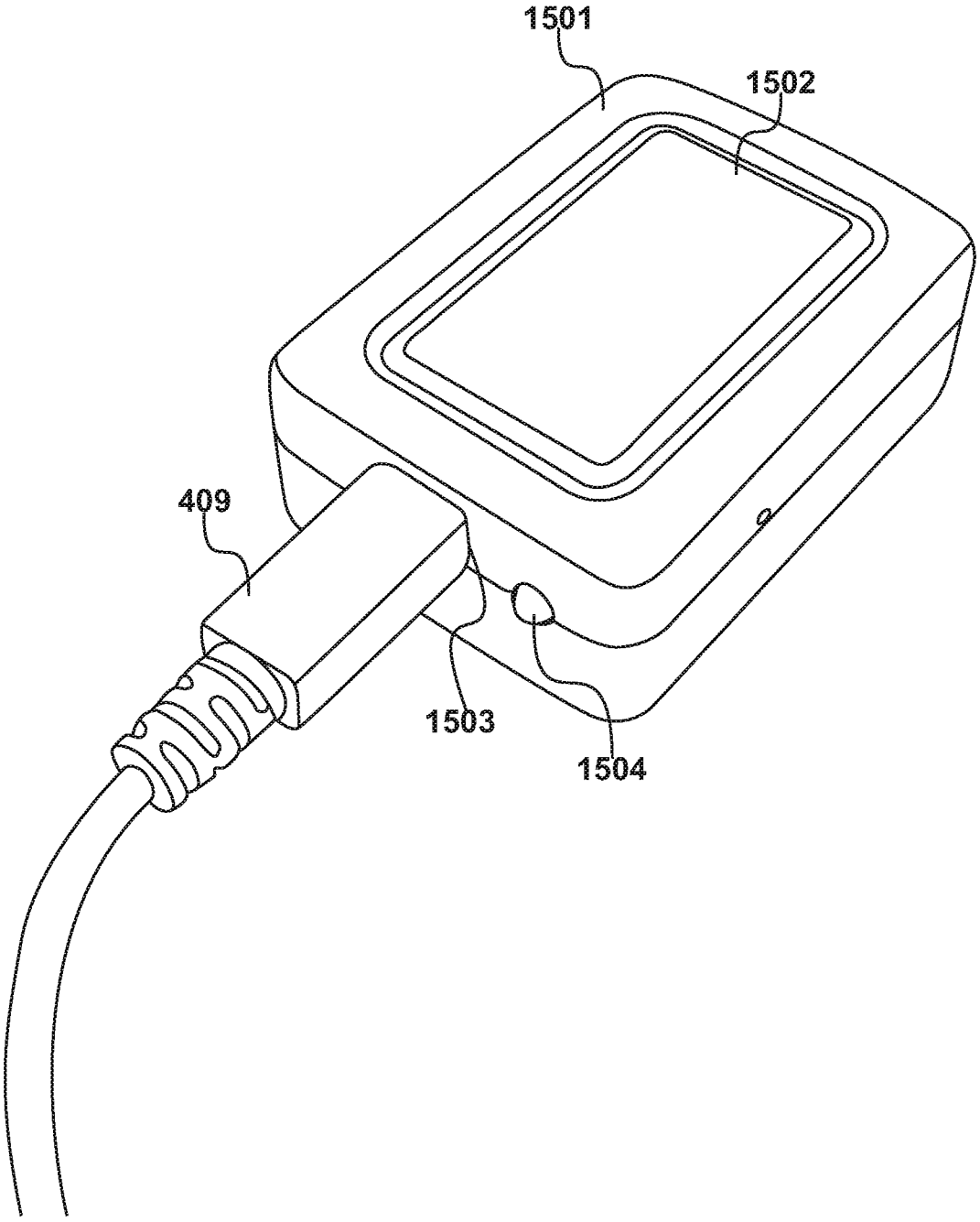
FIG. 15 shows a powered control unit.

An example of a powered control unit 1501 is shown in FIG. 15. The unit 1501 includes a large activation button 1502 that allows the unit to be activated and de-activated by the application of manual pressure while the unit is retained within an internal pocket 909. A USB-style loom socket 1503 receives an appropriate loom plug 409. A light-emitting diode 1503 is provided to provide battery status information during re-charging operations.

FIG. 16

Figure 16:
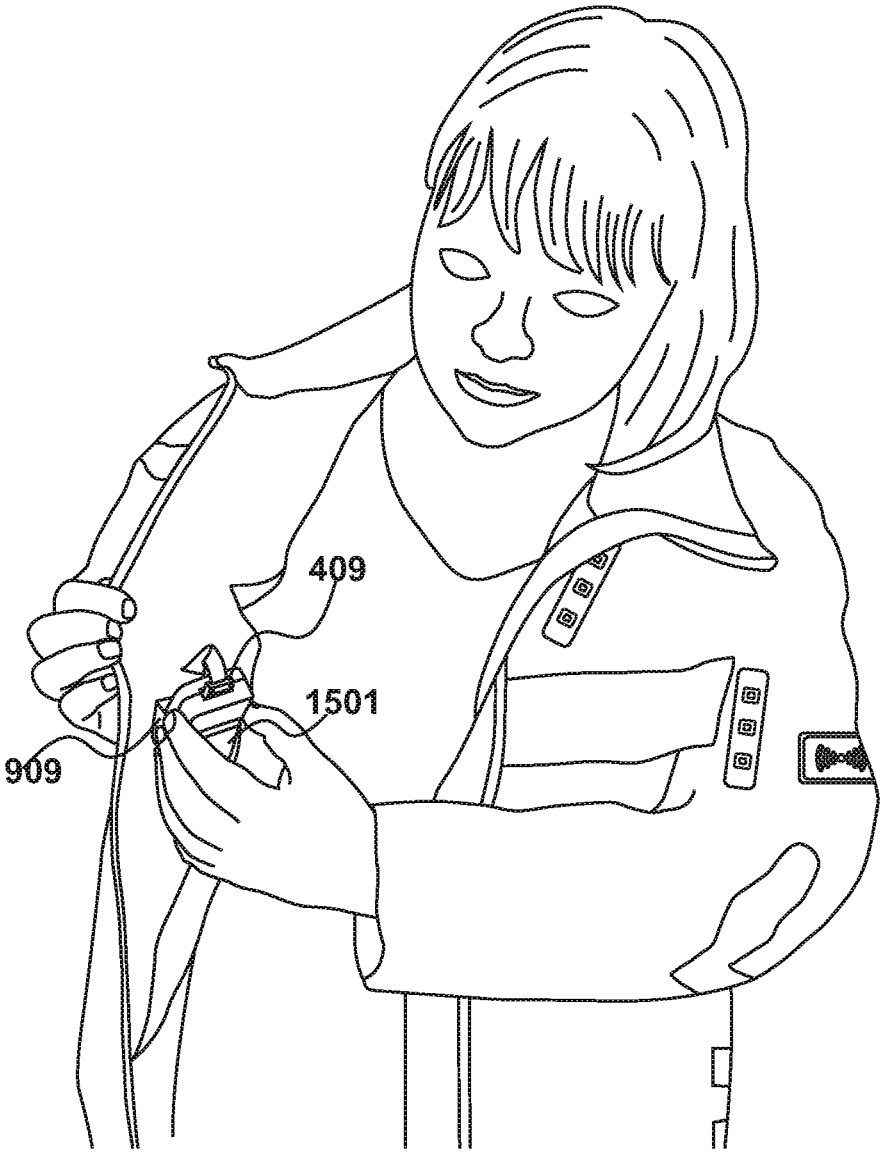
FIG. 16 shows the powered control unit of FIG. 15 being placed in an internal pocket.

As shown in FIG. 16, the outer loom hole 908 it is connected to the powered control unit 1501 after the loom plug 409 has been passed through the outer loom hole 908. The powered control unit 1501 is then inserted and retained within the internal pocket 909.

What is claimed is:

1. A high-visibility garment for use by operatives working in hazardous environments, comprising:

a base garment and a detachable light-reflecting apparatus, wherein, said base garment comprises:

an outer shell constructed from a florescent material;

an internal pocket;

a powered control unit retainable within said internal pocket, wherein said powered control unit includes a loom socket;

outer attachment material at positions intended for light-reflective material; and an outer loom hole in said outer shell and in said outer attachment material; and wherein, said detachable light-reflecting apparatus comprises:

a light-reflecting outer material;

a plurality of light-emitting devices extending through device holes in light-reflecting said outer material;

an inner attachment material; and a loom connecting said light-emitting devices, in which a restrained portion of said loom is located between said light-reflecting outer material and said inner attachment material, and an extended portion of said loom connects to a loom plug; and wherein, said loom plug is insertable within said loom socket by passing said extended portion through said outer loom hole; and said detachable light-reflecting apparatus is detachably attached to said base garment by attaching said inner attachment material to said outer attachment material.

2. The high-visibility garment of claim 1, wherein the detachable light-reflecting apparatus is attached to said base garment using a hook-and-loop system.

3. The high-visibility garment of claim 2, wherein said hook-and-loop system is Velcro.

4. The high-visibility garment of claim 2, wherein:

said outer attachment material is loop material of said hook-and-loop system; and said inner attachment material is hook material of said hook-and-loop system.

5. The high-visibility garment of claim 1, wherein:

said powered control unit includes an activation button; and said light-reflecting outer material includes a visual indicator to identify a position of said activation button when said powered control unit is retained in said internal pocket.

6. The high-visibility garment of claim 1, wherein said light-emitting devices are arranged in four groups.

7. The high-visibility garment of claim 6, wherein each said group includes three light emitting devices.

8. The high-visibility garment of claim 1, including an identification device.

9. A method of constructing a high-visibility garment for use by operatives working in hazardous environments, comprising the steps of:

passing an extended portion of a loom, extending from a detachable light-reflecting apparatus, through an outer loom hole in a base garment;

inserting a loom plug, at an end of said extended portion, into a loom socket in a powered control unit; and detachably attaching said detachable light-reflecting apparatus to said base garment, wherein:

said base garment comprises:

an outer shell constructed from a florescent material;

an internal pocket for retaining said powered control unit; and outer attachment material at positions intended for light-reflective material, including said outer loom hole; and said detachable light-reflecting apparatus comprises:

a light-reflecting outer material;

a plurality of light-emitting devices extending through device holes in said light-reflecting outer material; and an inner attachment material; and wherein a restrained portion of said loom connects said light-emitting devices, and said restrained portion is located between said light-reflecting outer material and said inner attachment material.

10. The method of claim 9, wherein said step of detachably attaching said detachable light-reflecting apparatus to said base garment comprises attaching said detachable light-reflecting apparatus to said base garment using a hook-and-loop system.

11. The method of claim 10, wherein said hook-and-loop system is Velcro.

12. The method of claim 10, wherein:

said outer attachment material is loop material of said hook-and-loop system; and said inner attachment material is hook material of said hook-and-loop system.

13. The method of claim 9, further comprising the step of activating said powered control unit, wherein:

said powered control unit includes an activation button; and said light-reflecting outer material includes a visual indicator to identify a position of said activation button when said powered control unit is retained in said internal pocket.

14. The method of claim 9, wherein said light-emitting devices are arranged in four groups and each said group includes three light emitting devices.

* * * * *